US011046554B2

(12) United States Patent
Wilson

(10) Patent No.: US 11,046,554 B2
(45) Date of Patent: Jun. 29, 2021

(54) STAIRLIFTS

(71) Applicant: Stannah Stairlifts Limited, Hampshire (GB)

(72) Inventor: Alexander Henry Gage Wilson, Hampshire (GB)

(73) Assignee: STANNAH STAIRLIFTS LIMITED, Hampshire (GB)

( * ) Notice: Subject to any disclaimer, the term of this patent is extended or adjusted under 35 U.S.C. 154(b) by 414 days.

(21) Appl. No.: 15/771,738

(22) PCT Filed: Oct. 19, 2016

(86) PCT No.: PCT/GB2016/053242
§ 371 (c)(1),
(2) Date: Apr. 27, 2018

(87) PCT Pub. No.: WO2017/072485
PCT Pub. Date: May 4, 2017

(65) Prior Publication Data

US 2018/0312372 A1 Nov. 1, 2018

(30) Foreign Application Priority Data

Oct. 27, 2015 (GB) ..... 1518943

(51) Int. Cl.
*B66B 9/08* (2006.01)
*A61G 5/12* (2006.01)
*A47C 7/50* (2006.01)

(52) U.S. Cl.
CPC ..... *B66B 9/0853* (2013.01); *A47C 7/50* (2013.01); *A61G 5/128* (2016.11)

(58) Field of Classification Search
CPC ..... B66B 9/0853; A61G 5/128; A47C 7/50
See application file for complete search history.

(56) References Cited

U.S. PATENT DOCUMENTS 4,243,265 A * 1/1981 Hanik ..... A61G 5/128 128/893
4,802,548 A * 2/1989 Kausch ..... B60K 28/00 180/274
5,052,521 A * 10/1991 Wendt ..... B66B 9/083 182/148
5,352,013 A * 10/1994 Rusyniak ..... A47C 7/506 297/119
10,081,517 B1 * 9/2018 Cheng ..... B66B 9/0853
2007/0284194 A1 * 12/2007 Woodhams ..... B66B 9/0853 187/202

(Continued)

FOREIGN PATENT DOCUMENTS

CN 102285570 A 12/2011
GB 2367808 A 4/2002
GB 2435463 A 8/2007

(Continued)

*Primary Examiner* — Michael A Riegelman
(74) *Attorney, Agent, or Firm* — Dinsmore & Shohl LLP

(57) ABSTRACT

The invention describes a footrest for a stairlift chair in which the safety mechanisms included in the footrest are enveloped in a flexible cover that allows the safety mechanisms to function in the intended manner yet prevents the intrusion of dirt and objects that might interfere with the operation of the safety mechanisms. Various further features are described to enhance the aesthetics of the chair.

9 Claims, 3 Drawing Sheets

(56) References Cited

U.S. PATENT DOCUMENTS

| | | | | |
|---|---|---|---|---|
| 2008/0203775 | A1* | 8/2008 | Caroen | B66B 9/08 297/30 |
| 2018/0312372 | A1* | 11/2018 | Wilson | A61G 5/128 |

FOREIGN PATENT DOCUMENTS

| | | | |
|---|---|---|---|
| JP | S6087184 | A | 5/1985 |
| JP | H07195987 | A | 8/1995 |
| NL | 9300085 | A | 8/1994 |

* cited by examiner

STAIRLIFTS

REFERENCE TO RELATED APPLICATIONS

This application is a U.S. national stage application of PCT/GB2016/053242, filed Oct. 19, 2016, which claims priority from Great Britain patent application No. 1518943.4, filed Oct. 27, 2015. The entire content of both of which is incorporated herein by reference.

FIELD OF THE INVENTION

This invention relates to stairlifts and, in particular, to aspects of a chair incorporated in a stairlift assembly

BACKGROUND OF THE INVENTION

A stairlift assembly comprises a rail mounted on a staircase; a carriage mounted on the rail for movement up and down the rail; and a chair mounted on the carriage, the chair supporting a passenger as the carriage moves along the rail. The chair typically includes a seat base, a seat back, a pair of armrests, and a footrest. Given that the footrest comprises that part of the chair closest to the treads of the staircase, it is common practice to mount safety edges on the footrest. These safety edges comprise one or more displaceable pads or flaps mounted on or adjacent to the leading and trailing edges of the footrest (as the carriage moves up and down the rail) and are wired into the electrical drive circuit of the stairlift. If, in the course of a journey, a safety edge comes into contact with an obstruction on the staircase, the safety edge will be displaced, will open a switch in the drive circuit, and thus cause the carriage to stop.

One or more further safety edges may be provided on the underside of the footrest to cut power to the stairlift drive motor in the event a the footrest encounters an obstruction vertically below the footrest.

In order to leave the foot-contacting surface of the footrest unimpeded, the safety pads are typically mounted on the underside of the footrest and it is generally convenient to incorporate the safety edges and cut-out switches in a sub-structure mounted to the underside of the footrest. However, whatever the case may be, a gap will be present in the footrest assembly, between the foot-contacting surface and the safety pads or sub-structure, to allow the safety mechanisms to function.

The traditional footrest assembly described above is not particularly pleasing from an aesthetic viewpoint and the gap allows the intrusion of unwanted dirt, moisture and even unwanted objects that could interfere with the operation of the safety edges. These risks are significantly greater in outdoor stairlift installations.

It is an object of this invention to go at least some way in addressing the limitations of existing stairlift footrest assemblies as described above; or which will at least provide a novel and useful choice.

SUMMARY OF THE INVENTION

In one aspect the invention provides a footrest for a stairlift chair, said footrest having an upper surface configured to support the feet of a user, and spaced lateral edges; said footrest further including at least one safety pad with an edge adjacent to one of said lateral edges and being characterised in that flexible covering is provided which extends along said lateral edges and overlies said at least one safety pad.

Preferably the flexible covering extending along both lateral edges is included in a single component.

Preferably said lateral edges are included in a footrest periphery, said single component overlying said periphery.

Preferably said single component defines an underside of said footrest.

Preferably that part of said single component defining the underside of said footrest, is re-enforced.

Preferably said single component overlies edge parts of said upper surface.

Preferably said single component defines on said upper surface a mounting aperture to receive a finishing footrest surface component.

Preferably said single component is a plastics or rubber moulding. More preferably said footrest is formed from ethylene propylene diene terpolymer (EDPM).

In a second aspect the invention provides a stairlift chair including the footrest set forth above.

Many variations in the way the present invention can be performed will present themselves to those skilled in the art. The description which follows is intended as an illustration only of one means of performing the invention and the lack of description of variants or equivalents should not be regarded as limiting. Wherever possible, a description of a specific element should be deemed to include any and all equivalents thereof whether in existence now or in the future.

BRIEF DESCRIPTION OF THE DRAWINGS

One working embodiment of the invention will now be described with reference to the accompanying drawings in which.

DETAILED DESCRIPTION OF THE INVENTION

Figure 1:
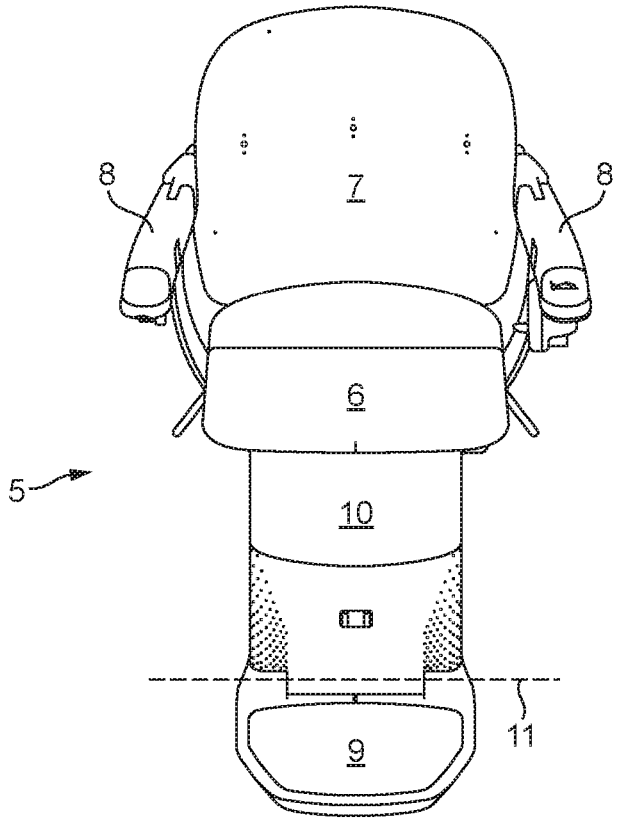
FIG. 1: shows a stairlift chair including a footrest according to the invention.

Referring firstly to FIG. 1, a stairlift chair 5 is depicted comprising a seat base 6, seat back 7, a pair of spaced armrests 8 and a footrest 9. Conventionally the footrest assembly 9 is mounted to the bottom of chair interface 10 by means of a hinge mechanism (not shown) such that the footrest may be folded up about hinge axis 11, substantially against the interface 10, when the stairlift is not in use. The footrest has spaced lateral edges 12, a front edge 13 and a rear edge 14, the combination of edges constituting a footrest periphery.

The invention is particularly concerned with the footrest 9 and thus the remainder of the chair, and its mounting on a stairlift rail (not shown), will not be described in further detail.

Figure 4:
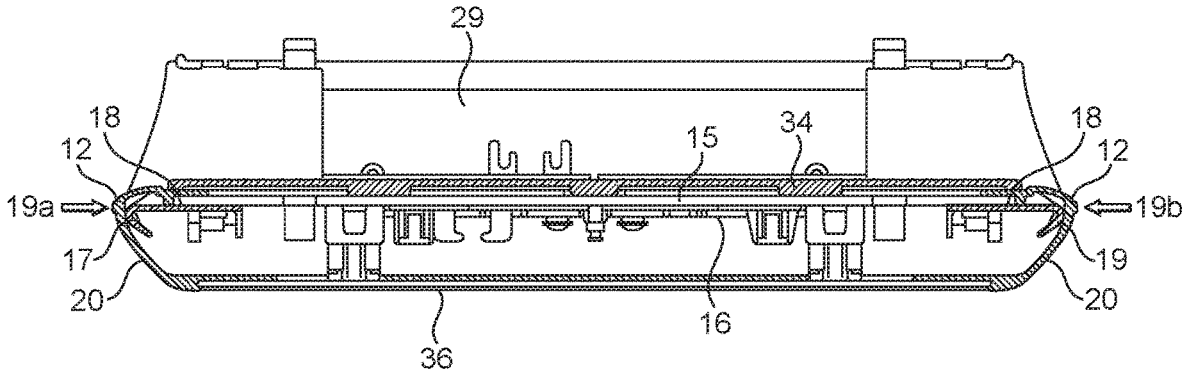
FIG. 4: shows an end-sectional view through a footrest according to the invention.

A stairlift is required, by regulation, to include some means of detecting an obstruction in the path of the stairlift, as it moves up and down the rail. Since the footrest is that part of the chair closest to the stairway, and thus an obstruction on the stairway, the requirement of the regulation is typically met by mounting a plurality of safety edges on the footrest, the safety edges being displaced in the event an obstruction is encountered, and opening one or more switches in the stairlift drive circuit to cut power to the drive motor. One arrangement of safety edges or pads is described in detail in our UK Patent No. 2 435 463, another being shown in FIG. 4 herein.

Figure 2:
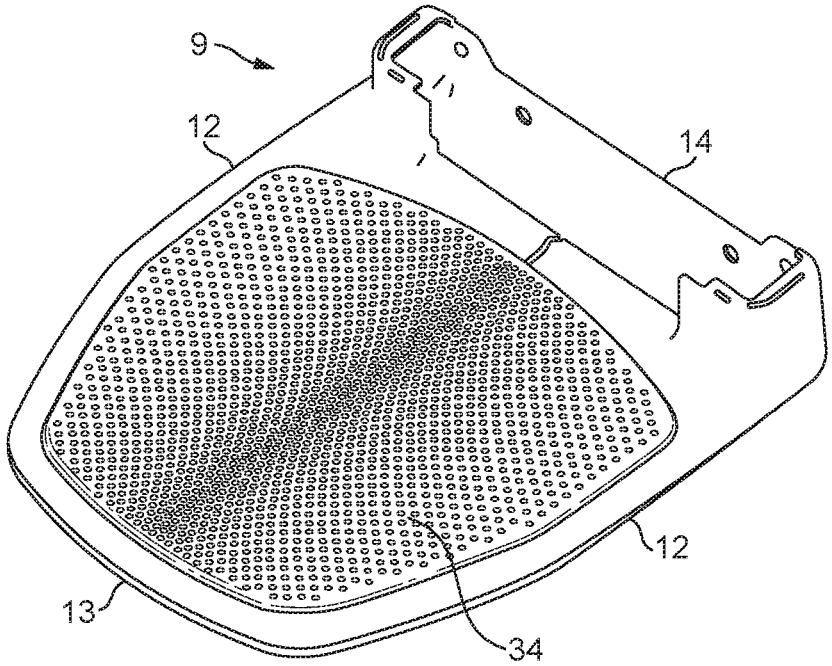
FIG. 2: shows an isometric view, from above, of a footrest according to the invention.

As shown in FIG. 2, the footrest assembly comprises a main plate-like structure 15 which forms the structural basis of the footrest, and a sub-structure 16 mounted on the underside thereof, the substructure including one or more safety pads or edges 17 together with one or more cut-out switches operated upon displacement of the safety edges 17. It will be seen that, on the lateral edges 12 of the footrest, the safety edges 17 project beyond the lateral edges 18 of the main footrest structure 15 and, upon coming into contact with an obstruction in the path of the footrest, will be displaced in the direction of arrow 19*a* in one direction, and arrow 19*b* when travelling in the opposite direction.

The precise form of the structure 15, sub-structure 16 and safety edges 17 does not constitute part of the invention. What characterises the invention is the provision of flexible coverings 20 which extend along the lateral edges 12 of the footrest assembly 9 and, in so doing, cover any gaps between the safety edges 17, and the structure 15 and sub-structure 16. The flexible coverings 20 are sufficiently robust to withstand repeated movement of the safety edges 17 yet have sufficient flexibility not to detract from the function of the safety edges. The coverings 20 not only improve the aesthetics of the footrest assembly but also prevent the intrusion of objects and fluids into the sub-structure 16 which might interfere with the safety mechanisms incorporated into the sub-structure.

Figure 3:
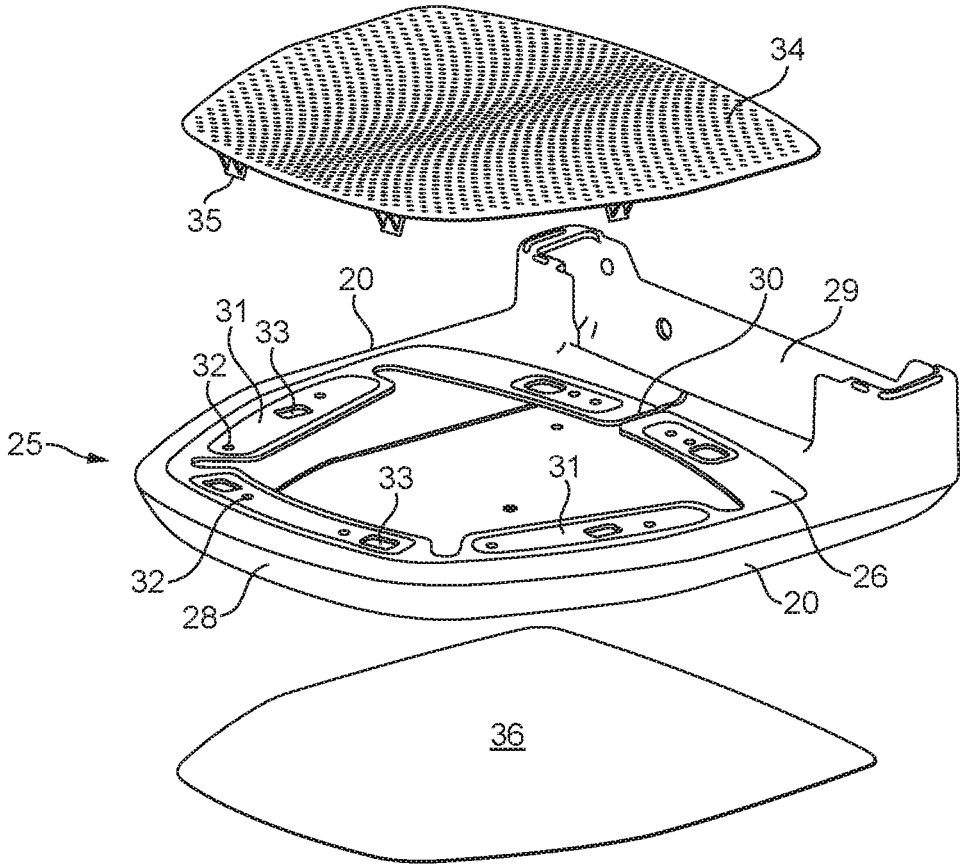
FIG. 3: shows an isometric exploded view of a number of components for forming a footrest according to the invention.

Referring now to FIGS. 2 & 3, the coverings 20 are preferably included in a single component 25 that defines the periphery of the footrest assembly and thus overlies the lateral, front and rear edges of the main structure 15 but further, preferably defines the underside of the footrest and thus envelops the sub-structure 16.

In the form shown the single component 25 is a moulded from a flexible natural or synthetic rubber material, one example of which is ethylene propylene diene terpolymer, more commonly referred to as EDPM. The component 25 has a top surface 26, a bottom surface 27 and peripheral edge surface 28 which includes the flexible coverings 20. A raised section 29 is provided along the rear edge to accommodate the hinge mounting between the footrest assembly 9 and the interface 10. A slit 30 is provided centrally along the upper surface 26 to enable parts of the upper surface 26 to be folded back while the component is being fitted over the main structure 15 and the sub-structure 16.

Figure 5:
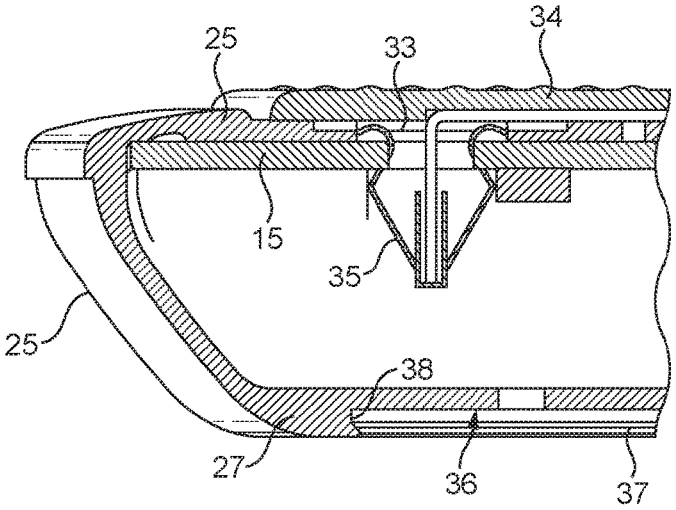
FIG. 5: shows an enlarged sectional view of part of a footrest according to the invention.

Referring to FIGS. 3 & 5, in the embodiment shown the upper surface 26 of component 25 is only partly defined, leaving the central area open but including tabs or flaps 31 to enable the component 25 to be fixed about edge parts of the upper surface of main structure 15. To this end the flaps include holes 32 to receive fasteners (not shown) for fastening the component to the main structure 15, and also include larger apertures 33 to receive clips 35 projecting downwardly from a finishing footrest surface component, preferably in the form of tread plate 34. The tread plate 34 is configured to overlie the tabs 31 and the open upper central section of component 25. The tread plate can, if desired, be provided in a variety of colours and textures to meet the needs of different users.

Also shown in FIGS. 3 & 5 is a re-enforcement plate 36 which is fixed to the bottom surface 27 of the component 25. To this end, the component 25 is preferably provided with a shallow cavity 37 on the underside thereof, the peripheral edge 38 defining the cavity having inwardly tapering edges to retain the plate 36 although retention of the plate can be supplemented, if necessary by the use of an adhesive between the plate 36 and the component 25.

It will be appreciated that the provision of plate 36 contributes rigidity to the component 25, particularly where the sub-structure 16 includes safety switches that are triggered in the event the foot rest bears down on an obstruction vertically below the footrest. However the plate can also contribute to the aesthetics of the stairlift as, when the stairlift is not in use and the footrest is folded up into the stowed position, the plate 36 will be exposed. Thus the plate 36 can, if desired, be provided in a variety of colours and/or textures to meet the demands of particular users.

The invention claimed is:

1. A footrest for a stairlift chair, said footrest comprising:

a main footrest structure having an upper surface and lateral edges;

at least one safety pad with an edge extending beyond one of said lateral edges such that said edge of said at least one safety pad is spaced outwardly from said one of said lateral edges of said main footrest structure; and a flexible covering extending along said one of said lateral edges, enclosing said at least one safety pad and covering said outward space between said edge of said at least one safety pad and said one of said lateral edges of the main footrest structure.

2. The footrest according to claim 1, wherein said flexible covering is included in a single component.

3. The footrest according to claim 2, wherein a periphery of the footrest is enclosed in said single component.

4. The footrest according to claim 2, wherein said single component defines an underside of the footrest.

5. The footrest according to claim 2, wherein a part of said single component defining said underside of the footrest is reinforced with a reinforcement plate.

6. The footrest according to claim 2, wherein said single component overlies edge parts of the upper surface.

7. The footrest according to claim 6, wherein said single component defines on the upper surface a mounting area to receive a finishing footrest surface component.

8. The footrest according to claim 2 wherein said single component is a plastics or rubber moulding.

9. The footrest according to claim 8, wherein said footrest is formed from ethylene propylene diene terpolymer (EDPM).

* * * * *